US009616354B2

(12) United States Patent
Montilla

(10) Patent No.: US 9,616,354 B2
(45) Date of Patent: Apr. 11, 2017

(54) RAILWAY MODELING ASSEMBLY SYSTEM

(71) Applicant: Joseph Montilla, Schaumburg, IL (US)

(72) Inventor: Joseph Montilla, Schaumburg, IL (US)

( * ) Notice: Subject to any disclaimer, the term of this patent is extended or adjusted under 35 U.S.C. 154(b) by 275 days.

(21) Appl. No.: 14/268,363

(22) Filed: May 2, 2014

(65) Prior Publication Data

US 2014/0332600 A1 Nov. 13, 2014

Related U.S. Application Data

(60) Provisional application No. 61/821,314, filed on May 9, 2013.

(51) Int. Cl.
*A63H 19/30* (2006.01)

(52) U.S. Cl.
CPC ..... *A63H 19/30* (2013.01); *Y10T 29/49826* (2015.01)

(58) Field of Classification Search
CPC ..... A63H 19/30
USPC ..... 238/10 R, 10 A, 10 E, 10 F
See application file for complete search history.

(56) References Cited

U.S. PATENT DOCUMENTS

| | | | | | |
|---|---|---|---|---|---|
| 3,288,368 | A * | 11/1966 | Athearn | A63H 18/02 | 191/22 C |
| 3,650,468 | A * | 3/1972 | Ewe | A63H 19/30 | 238/10 A |
| 6,089,466 | A * | 7/2000 | Fulton | A63H 19/30 | 238/10 B |
| 2006/0266845 | A1* | 11/2006 | Knowles | A63H 19/36 | 238/10 F |
| 2014/0332600 | A1* | 11/2014 | Montilla | A63H 19/30 | 238/10 A |
| 2015/0320201 | A1* | 11/2015 | Meadows | F16B 12/2009 | 108/64 |

* cited by examiner

*Primary Examiner* — Jason C Smith
(74) *Attorney, Agent, or Firm* — Bishop Diehl & Lee, Ltd.

(57) ABSTRACT

A model train railway assembly system having a plurality of foam boards cut to support at least one model train track on each board. Bus wires may be used to facilitate running of electricity along the track. The system comprising connecting a plurality of the assembled boards in a desired train track configuration.

17 Claims, 12 Drawing Sheets

RAILWAY MODELING ASSEMBLY SYSTEM

TECHNICAL FIELD OF THE INVENTION

The present system and methods relate to model railways. Specifically, the system and methods relate to the permanent and temporary assembly of model railway systems.

BACKGROUND OF THE INVENTION

Railway modeling is a hobby where rail transport systems are modeled on a smaller ratio or scale, thus becoming model trains. The models of rail transport systems vary widely in detail. Some include only scaled track and a train, while others add rolling landscape, multiple locomotives, roadways, various buildings, crossing signals, model figures, vehicles, lights and many other features.

Historically, the first model railways began to appear in the 1840s and were known as "carpet railways" because they ran directly on any floor without the need for a scaled-down track. Electric trains started to make an appearance in the early part of the 20th century. Early modeling was crude, but today's railway modeling is much more sophisticated.

Hobbyists involved with railway modeling can invest considerable amounts of time in their hobby, and this can range from simply owning a train set to actually investing hours of time and lots of money in creating a huge and realistic model of both railroad and scenery. The layout through which model trains pass begin with the connecting of straight and curved track sections usually secured onto a wooden or foam platform.

Problems with prior art railway systems have been related to track instability, track connection issues, distribution of electricity, universality of track, modifying layouts, and transportation issues due to size and overall weight.

Until the invention of the present application, these and other problems in the prior art went either unnoticed or unsolved by those skilled in the art. The present invention provides a railway modeling assembly system which solves these and other problems without sacrificing portability features, design, style or affordability.

BRIEF DESCRIPTION OF THE DRAWINGS

For the purpose of facilitating an understanding of the subject matter sought to be protected, there are illustrated in the accompanying drawings and appendix, embodiments thereof, from an inspection of which, when considered in connection with the following description, the subject matter sought to be protected, its construction and operation, and many of its advantages should be readily understood and appreciated.

DETAILED DESCRIPTION OF THE INVENTION

While this invention is susceptible of embodiments in many different forms, there is shown in the various drawings, and will herein be described in detail, at least one preferred embodiment of the invention with the understanding that the present disclosure is to be considered as an exemplification of the principles of the invention and is not intended to limit the broad aspect of the invention to any of the specific embodiments illustrated.

Referring to FIGS. 1-12, there is illustrated a railway assembly system, including track sections generally designated by the numeral 10. The particular illustrated assembly system shows only straight and curved sections for single and double-track railway layouts. However, it should be understood that the principles of the invention can be more broadly applied to any multi-track assemblies having numerous lengths of straight, curved and specialty track sections (e.g., "S" curves, hills, etc.), as well as being applicable to most any size of track in commercial use.

As can be seen in the various figures, each track section 10 of the present invention is comprised of a foam board 12, cut to a desired shape and size, and a section of model train track 14 mounted thereon. Each individual track section 10 can be easily positioned adjacently and connected to another section for quick and simple assembly of a desired layout.

Figure 1:
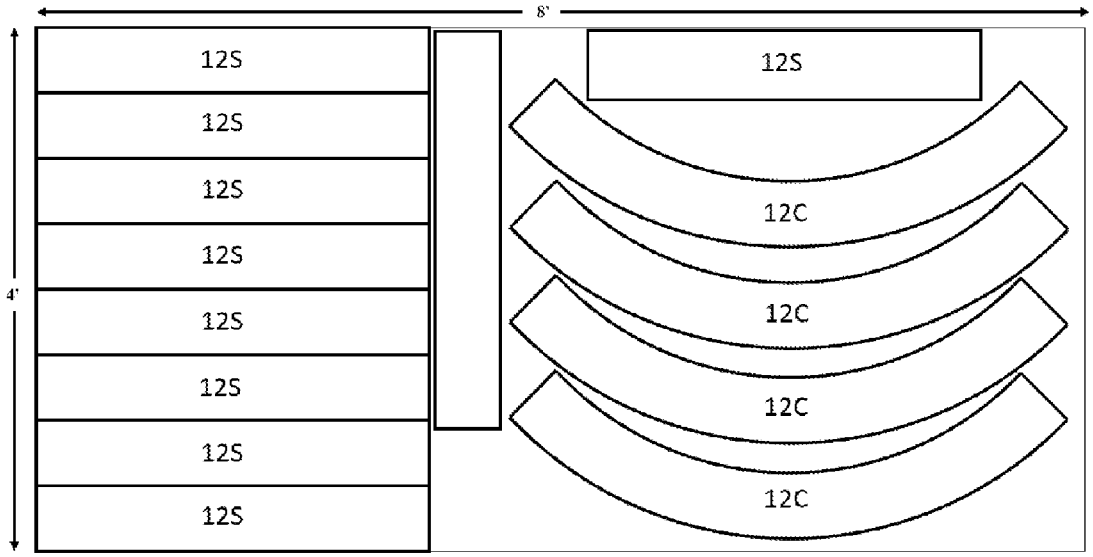
FIG. 1 is a top view of one embodiment of a foam board layout to cut out multiple track bases.
Figure 2:
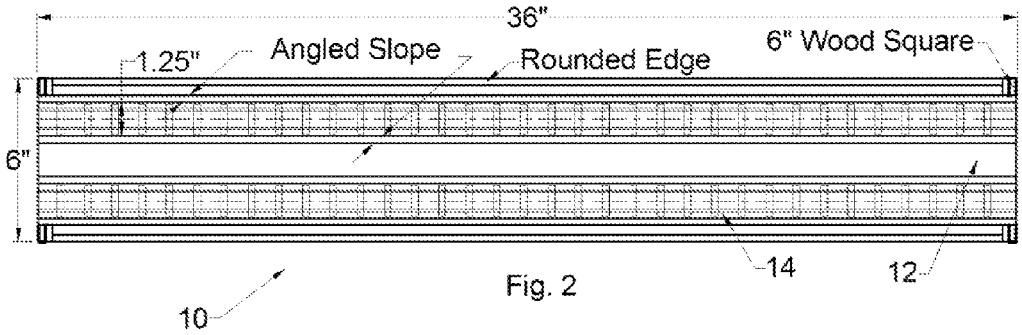
FIG. 2 is a top view of a straight track section mounted on a foam board.
Figure 3:
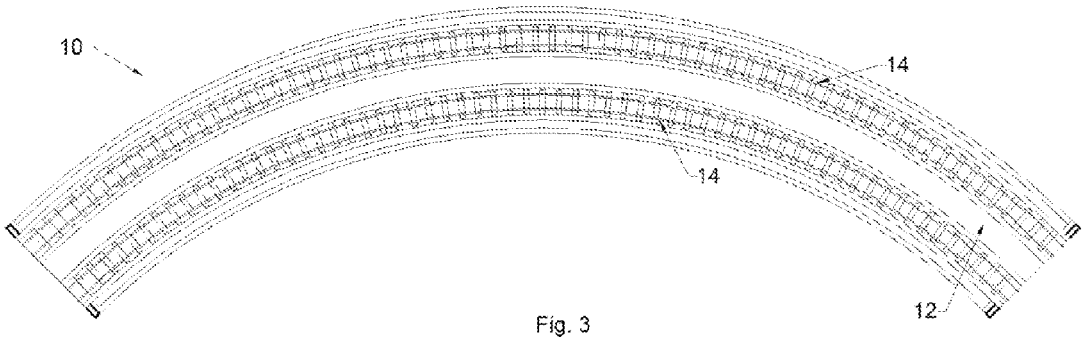
FIG. 3 is a top view of a curved track section mounted on a foam board.

The foam board 12 used in the present invention can be manufactured in individual sections by an extrusion or similar process and/or each piece may be cut from larger foam board panels, as illustrated in FIG. 1. For example, FIG. 1 illustrates how ten (10) straight foam boards (S) and four (4) curved foam boards (C) can be cut from a four foot by eight foot foam board for a specific model track (see FIGS. 2 and 3). Of course, smaller or larger sections could be mapped on a board to make maximum use of the board surface area. The foam boards are preferably made from an expanded polystyrene (EPS) foam material. Alternatively, other expanded polymer foams may be suitable, as would be a paper board with an EPS or other foam core. These materials are typically sufficiently rigid, while still being lightweight and easy to cut. The EPS foam material can be formed to most any dimension and is relatively inexpensive.

Figure 6:
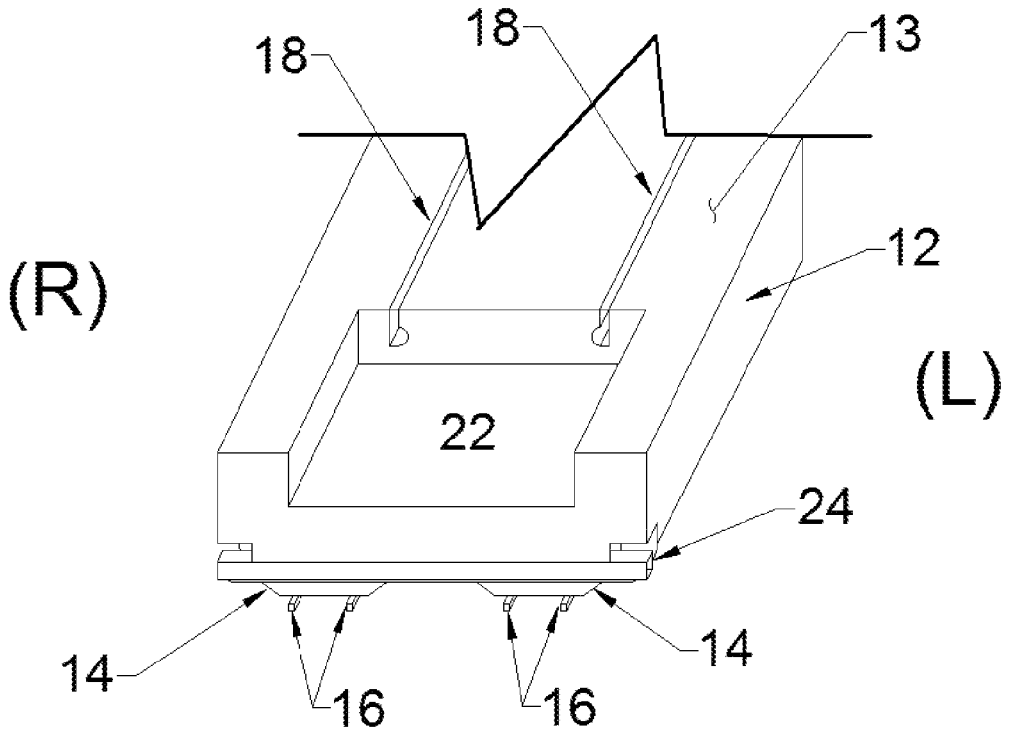
FIG. 6 is a bottom view of a track board showing an electrical bus wire cutout.

The individual train track 14 can be glued or otherwise secured directly to the foam board 12 (see FIG. 6). The track 14 should be positioned and secured to the board 12 such that the connecting rail ends 16 of the train track 14 extend slightly beyond each end of the board 12. This configuration allows connection between two sections 10.

Figure 4:
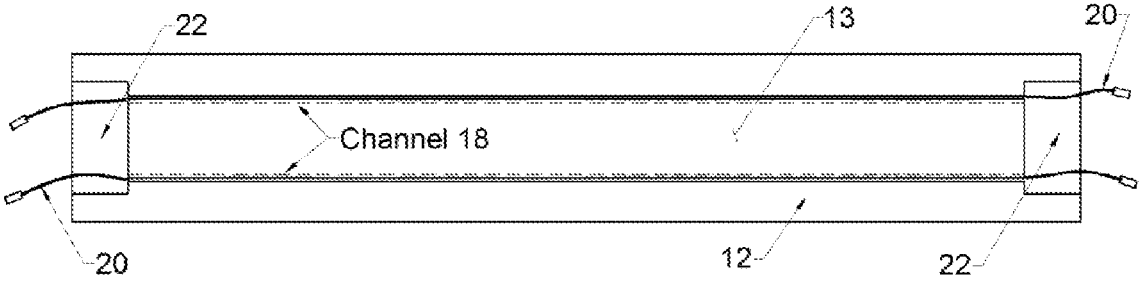
FIG. 4 is a bottom view of a foam board with mounted track showing a bottom channel for electrical bus wire.
Figure 7:
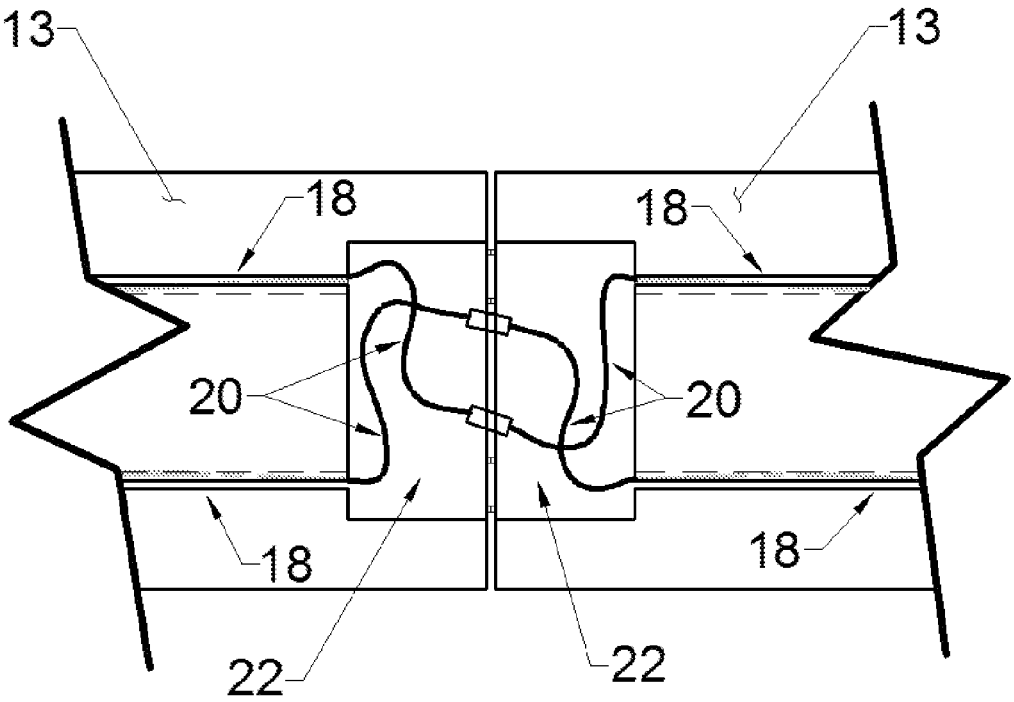
FIG. 7 is a bottom view of two connected track sections showing the cavity created for holding bus wires.

As shown in FIGS. 4 and 6, a pair of channels 18 are used to run bus wires 20 through or along the bottom of each track section 10. The channels 18 can be readily cut into the bottom of the foam board 12 or the board 12 can be extruded with the dual channels 18 therein. Small cutouts 22 in the bottom surface 13 at the end of each board 12 allow the bus wire 20 from adjacent and connecting track sections to be coupled and held out of view, as illustrated in FIG. 7.

Figure 5:
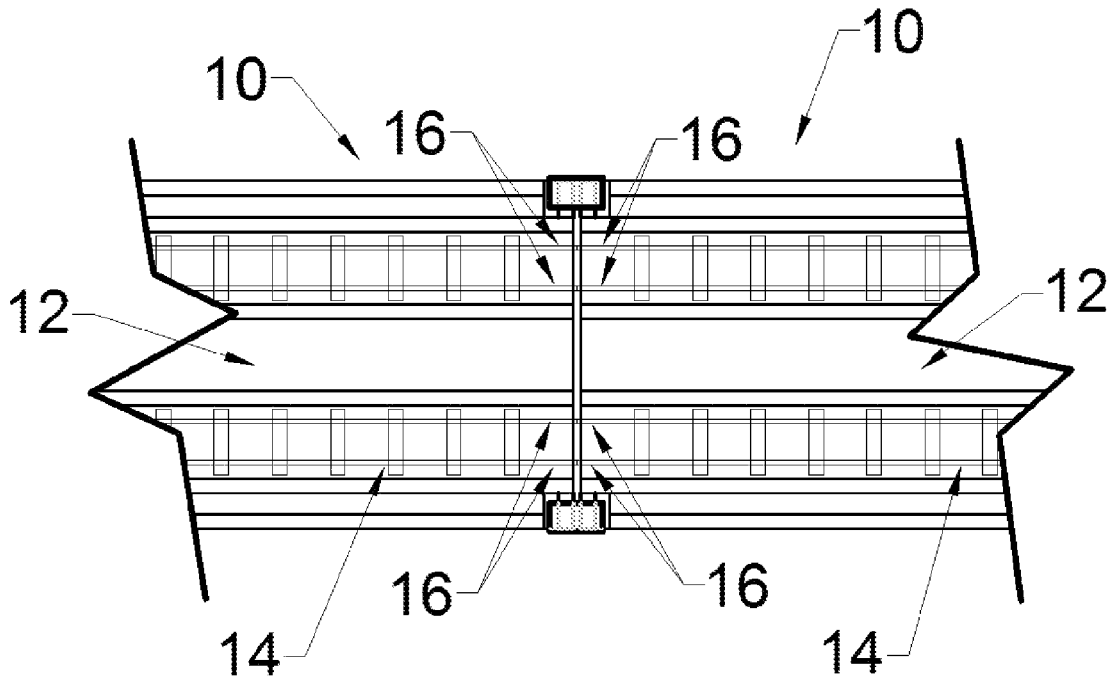
FIG. 5 is a top view of two connected track sections.
Figure 8:
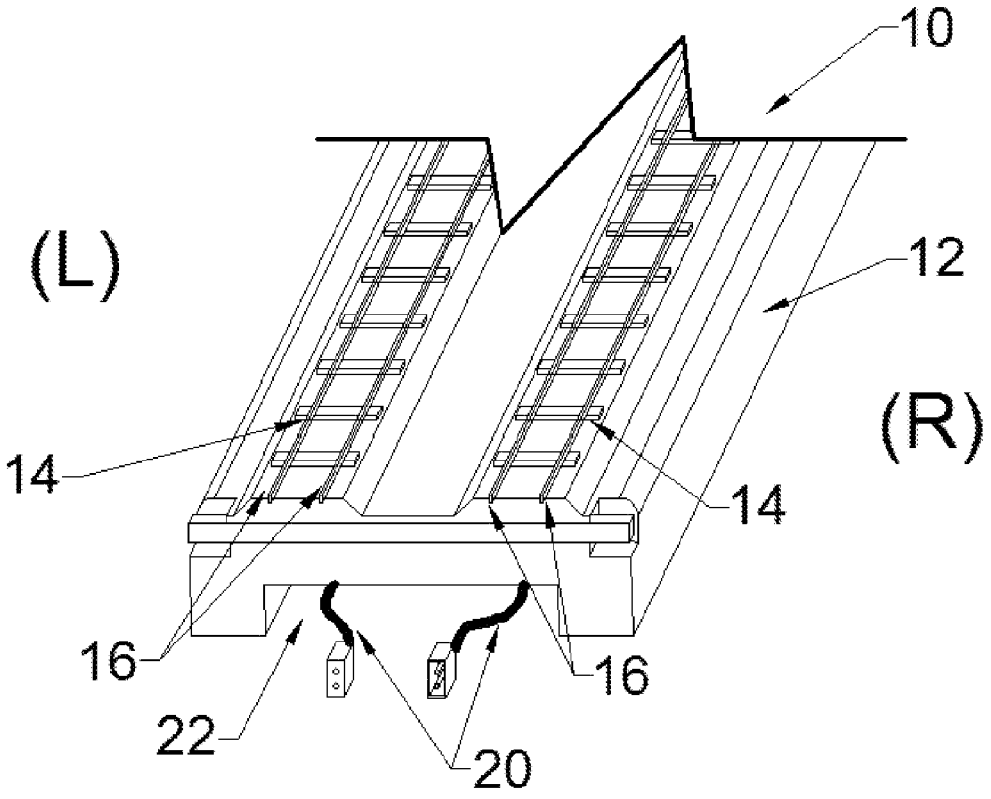
FIG. 8 is a perspective view of an end of a track section.

To further facilitate connecting two track sections 10 of the assembly by a hobbyist, with reference to FIG. 8, a bar 24, preferably made of wood, plastic or some other comparably rigid material, is fastened flush to each end of the board 12 along a top edge so as to either extend beyond left and right sides (L and R) of the board 12 or otherwise be positioned to facilitate grasping of the bar 24. FIG. 8 shows small cut-out areas 26 adjacent each end of the bar 24 to allow access to the bar 24. These configurations allows a user to grasp or otherwise engage the bars 24 on two adjacent boards 12 and move them together, thereby connecting the track sections 10, as shown in FIG. 5.

Figure 9:
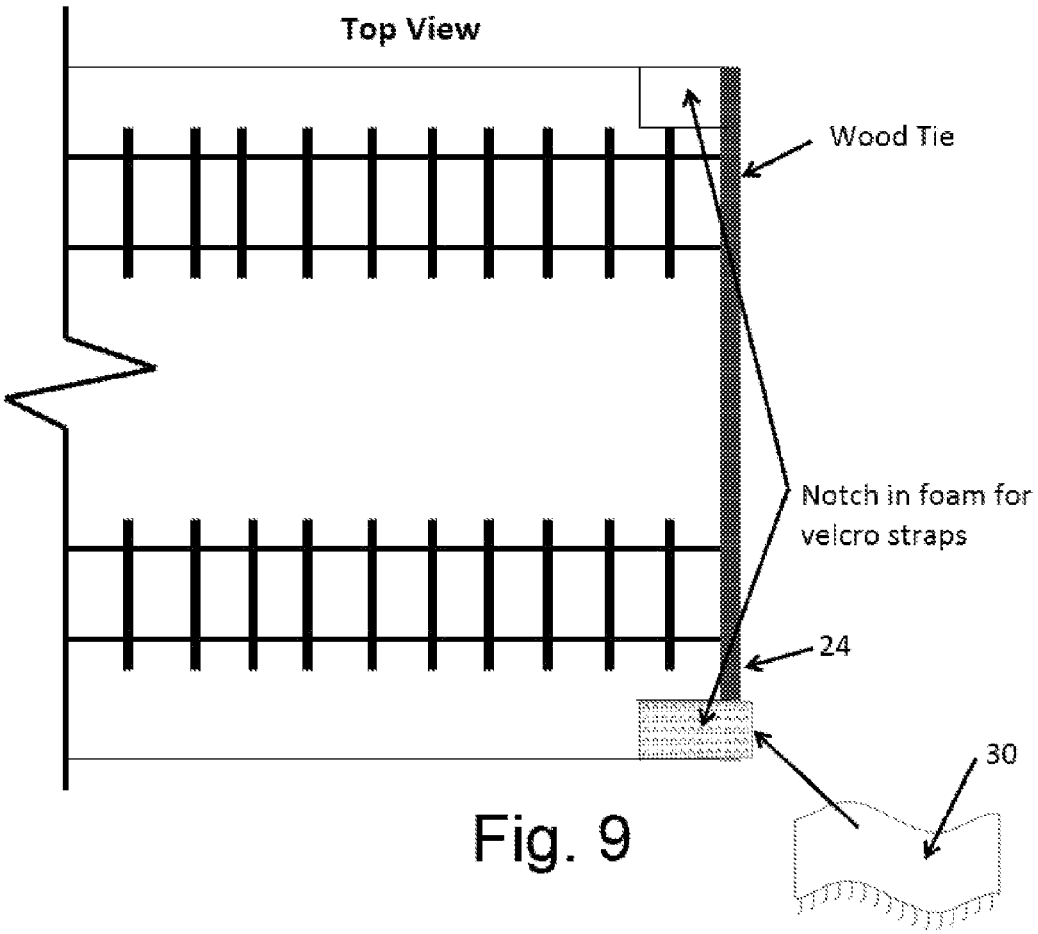
FIG. 9 is a top view of a schematic showing a double-track embodiment of the present invention.
Figure 10:
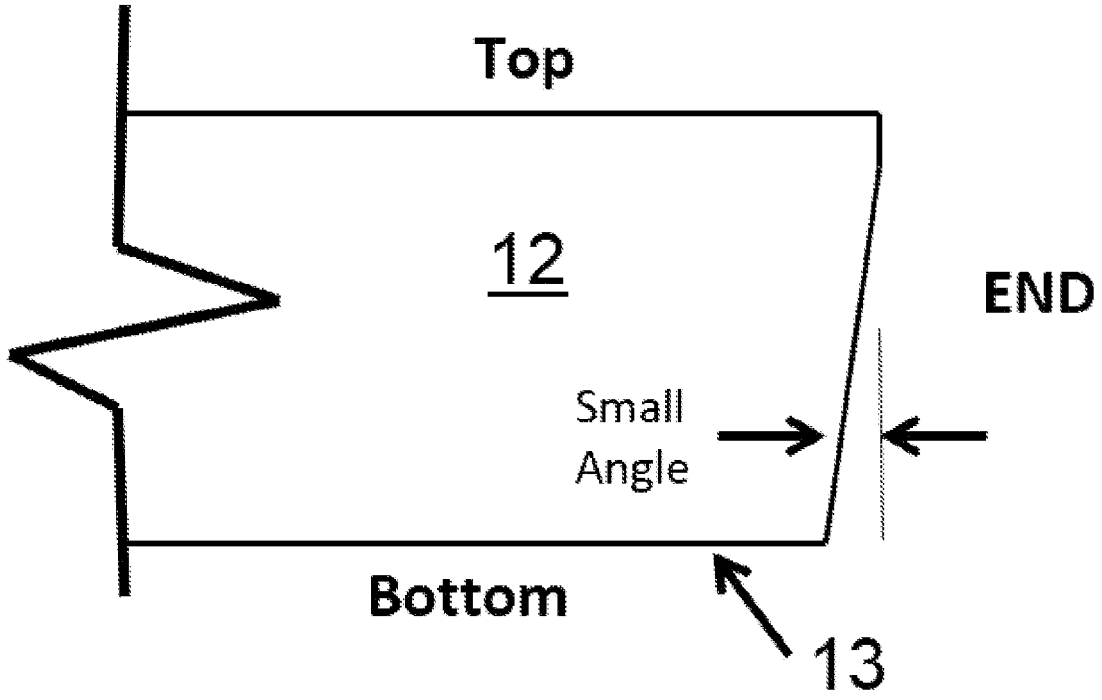
FIG. 10 is a side view illustrating beveling on track boards.
Figure 11:
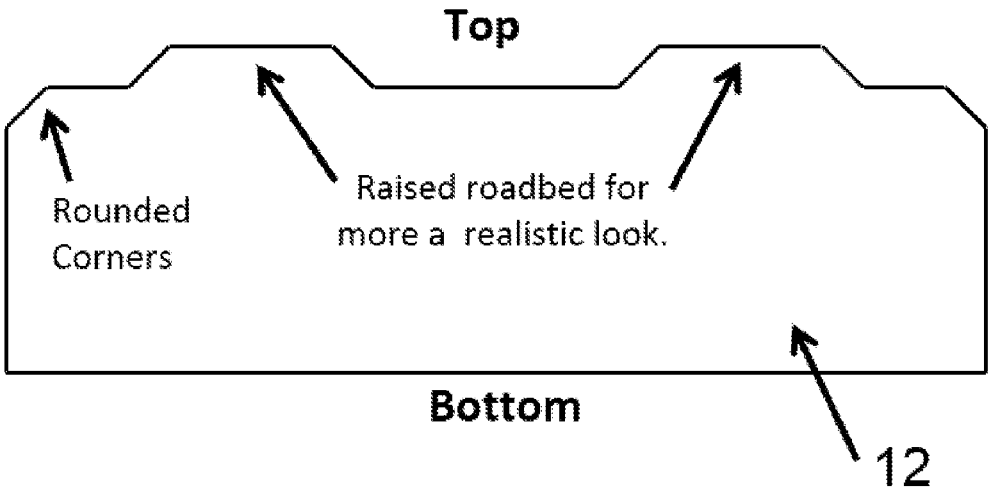
FIG. 11 is a cross-sectional view of one embodiment of a contoured track board.

Clamps (not shown) or other locking mechanisms may be used to secure the two adjacently connected sections 10 together to prevent accidental disconnection. Other and/or alternate features of the inventive assembly system may include the use of VELCRO® (or similar material) straps 30 to bind adjacent track sections 10 together, as illustrated in FIG. 9. It may also be possible to cut, shave, or manufacture the foam boards 12 with a slight angle to the front end face (see FIG. 10) to allow sections 10 to connect at a slight angle for creating hills or the like. As shown in FIG. 11, the top surface of a foam board 12 may also be contoured to give a more realistic look to the assembled railway.

Figure 12:
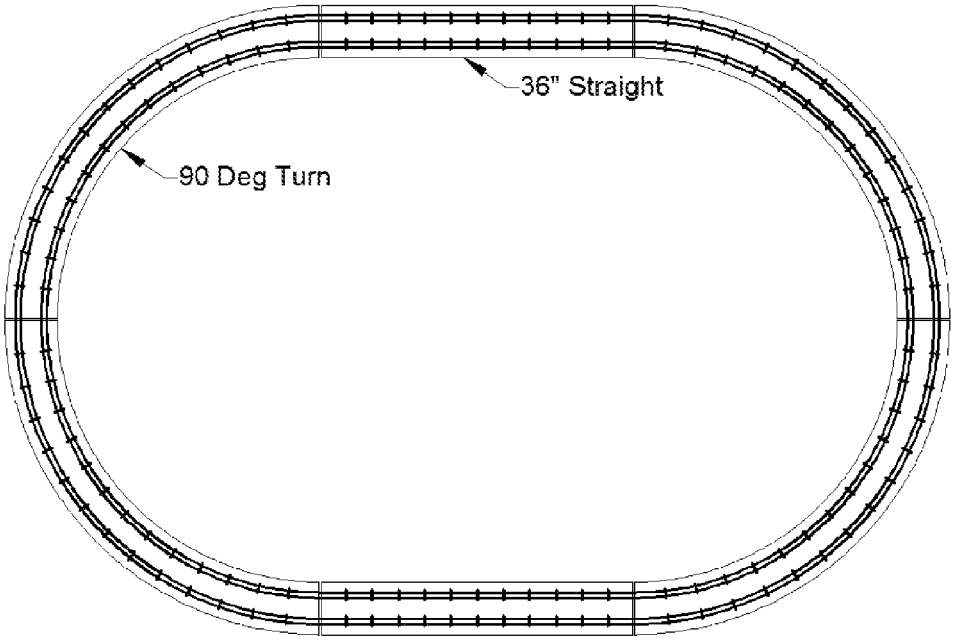
FIG. 12 is a simple oval layout of track using an embodiment of the present invention.

FIG. 12 illustrates a simple oval double-track design layout using two (2) straight sections 10S and four (4) curved sections 10C. The illustrated layout is approximately 9'×24' (W×L) and all the wiring is neatly hidden away within the foam boards 12. Construction of other configurations too numerous to illustrate would certainly be understood by those skilled in the art from a reading of the subject disclosure.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

The invention claimed is:

1. A railway modeling assembly section comprising:
- a rigid foam substrate; and
- a section of scaled train track comprised of a first rail and a second rail, each rail having first and second connecting ends and the train track being secured to a surface of the rigid foam substrate, wherein the connecting ends of the first and second rails extend past edges of the substrate.

2. The railway modeling assembly section of claim 1, further comprising bus wire connected to the train track and positioned within a channel in the rigid foam substrate.

3. The railway modeling assembly section of claim 2, wherein the rigid foam substrate comprises a recessed area connecting to the channel.

4. The railway modeling assembly section of claim 1, wherein the rigid foam substrate has a contoured upper surface.

5. The railway modeling assembly section of claim 1, wherein the rigid foam substrate has a beveled face surface for facilitating connection to another section.

6. The railway modeling assembly section of claim 1, further comprising a securing member attached to the rigid foam substrate.

7. The railway modeling assembly section of claim 6, wherein the securing member is hook and loop material.

8. The railway modeling assembly section of claim 6, wherein the securing member is a clamp.

9. The railway modeling assembly section of claim 1, further comprising a bar attached to a connecting end of the foam substrate in a position to facilitate connection to another section.

10. A railway modeling assembly system comprising:
- a plurality of track sections, each section begin comprised of:
  - a rigid foam substrate;
  - a section of scaled train track having a first rail and a second rail and being secured to a surface of the rigid foam substrate; and
  - bus wire connected to the train track and running through the rigid foam substrate with an end positioned proximate an end of the rigid foam substrate;
- wherein the plurality of track sections are connected together, via the train track first and second rails and the end of the bus wire of each section, to form a configuration onto which an electric model train can run when an electric current is delivered to the plurality of track sections through the bus wire.

11. The railway modeling assembly system of claim 10, wherein the rigid foam substrate comprises a channel for positioning of the bus wire.

12. The railway modeling assembly system of claim 10, wherein at least one of the plurality of track sections comprises a rigid foam substrate having a contoured surface.

13. The railway modeling assembly system of claim 10, wherein at least some of the plurality of track sections are curved.

14. The railway modeling assembly system of claim 13, wherein at least some of the plurality of track sections are straight.

15. A method for constructing a model railway track system comprising the steps of:
- providing a section of rigid foam board;
- attaching a section of model train track to the section of rigid foam board, the train track being comprised of:
  - a first rail and a second rail; and
  - bus wire connected to the first and second rails and running through the rigid foam board with an end positioned proximate an end of the rigid foam board;
  - wherein the first rail and second rail of the section of track connect to a first rail and second rail of another section of track and the bus wire of the section of track connects to a bus wire of the other section of track, to produce a railway assembly section; and
- connecting a plurality of railway assembly sections to one another in a desired configuration.

16. The method for constructing a model railway track system of claim 15, wherein the step of providing a section of rigid foam board comprises the steps of marking a larger rigid foam board with outlines of a plurality of smaller rigid foam board sections and cutting the smaller rigid foam board sections out.

17. The method for constructing a model railway track system of claim 15, further comprising the step of cutting a channel into the rigid foam board and connecting bus wire to the track and positioning the bus wire within the channel.

* * * * *